United States Patent [19]

Sung et al.

[11] 4,171,270

[45] Oct. 16, 1979

[54] SULFURIZED OVERBASED CALCIUM ALKYLPHENOLATE LUBRICANT COMPOSITION

[75] Inventors: Rodney L. Sung, Fishkill; Benjamin H. Zoleski, Beacon, both of N.Y.; Herbert C. Morris, Sugarland, Tex.; Elmer E. Schallenberg, Fishkill, N.Y.

[73] Assignee: Texaco Inc., White Plains, N.Y.

[21] Appl. No.: 754,703

[22] Filed: Dec. 27, 1976

[51] Int. Cl.[2] ..... C10M 1/54; C10M 3/48; C10M 5/28; C10M 7/52

[52] U.S. Cl. ..... 252/42.7; 252/45; 252/395; 252/47.5; 252/46.6

[58] Field of Search ..... 252/33, 42.7, 45, 395

[56] References Cited

U.S. PATENT DOCUMENTS

| | | | |
|---|---|---|---|
| 3,367,867 | 2/1968 | Abbott et al. | 252/42.7 |
| 3,377,281 | 4/1968 | Gower | 252/33 |
| 3,474,035 | 10/1969 | Dadura | 252/42.7 |
| 3,528,917 | 9/1970 | Dadura et al. | 252/42.7 |
| 3,562,159 | 2/1971 | Martin | 252/33 |
| 3,761,414 | 9/1973 | Hangen et al. | 252/42.7 |
| 3,775,321 | 11/1973 | Zurnquest et al. | 252/42.7 |
| 3,969,235 | 7/1976 | Sung et al. | 252/42.7 |
| 4,010,106 | 3/1977 | Rothert | 252/42.7 |
| 4,016,093 | 4/1977 | Koft | 252/42.7 |

*Primary Examiner*—Delbert E. Gantz
*Assistant Examiner*—Irving Vaughn
*Attorney, Agent, or Firm*—Thomas M. Whaley; Carl G. Ries; James J. O'Loughlin

[57] ABSTRACT

Lubricant oil comprising a hydrocarbon oil of lubricating viscosity, a sulfurized overbased calcium alkylphenolate detergent-inhibitor having a calcium metal to alkylphenol ratio of at least 2.9:2; and a sulfurized naphthenic base oil-contaning composition having a sulfur content of from 1 percent to 6 percent by weight.

15 Claims, No Drawings

SULFURIZED OVERBASED CALCIUM ALKYLPHENOLATE LUBRICANT COMPOSITION

BACKGROUND OF THE INVENTION

This invention occurs in the field of art involving, generally, lubricating oils adapted for use between a plurality of relatively moving surfaces, with which the fluid compositions are in contact, for the purpose of reducing the friction between these surfaces while providing protection, concomitantly, from wear and corrosion. This fluid compositions, or lubricating oils, tend to deteriorate under conditions of use in present day diesel engines with attendant formation of sludge, lacquer and resinous materials which adhere to the engine parts; particularly the piston ring, groove and skirt, thus reducing the operating efficiency of the engine. To counteract the formation of these deposits, certain chemical additives have been found which when added to lubricating oils have the ability to keep the deposit forming materials suspended in oil so that the engine is kept clean and in efficient operating condition for extended periods of time. These agents are known in the art to which this invention pertains as detergents, dispersants or detergent-inhibitors. Metal organic compounds are particularly useful in this respect. One class of metal organic compounds which has been found so useful are the sulfurized normal and overbased calcium alkylphenolates. These agents are believed to be effective because they provide alkalinity capable of neutralizing strong organic and inorganic acids and are capable of inhibiting deposits and deposit precursors in the oil phase. Overbased sulfurized metal alkylphenolates have been found to be particularly effective detergent-inhibitors in lubricating oils.

By the term "overbased" in this context is meant, generally, that the ratio of the number of equivalents of calcium to the number of equivalents of phenol moiety is greater than 1. In the present instance, the term is further defined to mean that the ratio of the number of calcium metal to the number of alkylphenolate moiety is at least 2.9 to 2, respectively. In contrast, many overbased sulfurized metal alkylphenolates having a calcium metal to alkylphenolate ratio less than 2.9:2 have proven to be useful lubricant additives heretofore. Normal calcium alkylphenolates also provide useful lubricant additives. The term "normal" indicates that the ratio of the number of equivalents of calcium moiety to alkylphenol moeity is 1. U.S. Pat. Nos. 3,528,917; 3,549,534; 3,761,414; and 3,969,235 describe lubricating compositions containing sulfurized normal calcium alkylphenolate detergent-inhibitors of improved resistance to oxidation. Sulfurized overbased calcium alkylphenolate additives have often been found to be of particular utility as detergent-inhibitors. Illustrative of these lubricant compositions are those sulfurized calcium alkylphenolate detergent-inhibitors described in U.S. Pat. Nos. 3,474,035 and 3,706,632.

It has been found recently, however, that railway diesel engine oils having a high degree of alkalinity, that is, a TBN of at least 10, are particularly desirable in that they prevent oxidation and corrosion by oil-soluble acids formed by oxidative deterioration at the high temperatures existing under normal conditions of engine employment in proximity to the combustion chamber. While this alkalinity can be attained by introduction into the lube oil of a nominal 300 TBN forty percent to fifty percent overbased calcium sulfonate in a naphthenic oil carrier, the resulting lubricant compositions are unsatisfactory because these overbased materials degrade the silver protection characteristics of the oil, a factor of particular significance with respect to railway diesel engines, the vast majority of which, in the United States, and to a significant extent outside of the United States, as well, utilize silver-plated piston pin insert bearings. The term "TBN" or "nominal TBN" as employed herein refers to "total base number" which is defined as the quantity of acid, expressed in terms of the equivalent number of milligrams of potassium hydroxide that is required to neutralize all basic constituents present in one gram of a given sample. The method of evaluation is that defined is ASTM Method D 664.

Thus, the production of an effective, inexpensive detergent-inhibitor as an additive for lubricant oils for use in railway diesel engines that would provide an oil having the necessary degree of alkalinity without diminution of its silver protection properties would represent a significant advance in the state of the art.

SUMMARY OF THE INVENTION

We have discovered, and this constitutes our invention, that an improved sulfurized calcium alkylphenolate lubricant composition, substantially less susceptible to oxidative deterioration even at the elevated temperatures existing in proximity to the combustion chamber of a present day railway diesel engine, when in use, and protective of the silver components of the engine is secured using a sulfurized overbased calcium alkylphenolate detergent-inhibitor wherein the calcium metal to alkylphenolate ratio is at least 2.9:2, and a sulfurized naphthenic lubricating oil incorporating from about 1 percent to about 6 percent by weight of elemental sulfur.

DETAILED DESCRIPTION OF THE INVENTION

More specifically, this invention is directed to lubricant oils capable of meeting standards of performance necessary to satisfy present day needs of railway diesel engines having silver-plated components. These rigorous standards include a significantly high degree of alkalinity, i.e., a nominal total base number ("TBN") of at least 10, and the ability simultaneously to provide protection to the silver-plated areas of the engine.

The lubricant compositions of the invention comprise a hydrocarbon oil of lubricating viscosity; a sulfurized naphthenic lubricating oil additive incorporating about 1 percent to about 6 percent, and preferably within the range of about 2 percent to 5 percent, and most desirably about 3 percent, of sulfur (in combined form) by weight of the sulfurized oil additive; and a sulfurized overbased calcium alkylphenolate detergent-inhibitor wherein the calcium metal to alkylphenolate ratio is at least 2.9:2, more desirably from 2.9:2 to 3.5:2, and preferably 3:2. The detergent-inhibitors for use herein are prepared, generally, by contacting in the presence of a lubricating oil, (1) an alkylphenol of the formula:

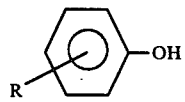

(I)

wherein R represents 1 or 2 monovalent saturated aliphatic hydrocarbon or alkyl radicals, each of from 4 to 50 carbons, and preferably 10 to 15 carbon atoms, and where, in said alkylphenol, at least one ortho or para position remains unsubstituted, (2) with a calcium alkoxyalkoxide of the formula:

$$Ca—(O\text{-}A\text{-}OR')_2 \quad (11)$$

wherein A is a divalent saturated aliphatic hydrocarbon radical (alkanediyl) of 1 to 6 carbon atoms; and R' is an alkyl radical of from 1 to 25 carbon atoms inclusive; said contact being effected at a temperature of from 50° F. to 425° F. in one step or two steps; and utilizing a mole ratio of calcium alkoxyalkoxide to said alkylphenol, in said one step or in the total of said two steps, of from 0.5:1 to 0.6:1; introducing sulfur, at a temperature of from 165° F. to 460° F., and preferably 410° F. to 450° F., after the first of said foregoing steps, into contact with the resulting reaction mixture; utilizing a mole ratio of sulfur to initial alkylphenol of between 0.5:1 and 0.8:1; and in the presence of a hydrocarbon lubricating oil, said hydrocarbon oil constituting between about 13 percent and 20 percent by weight of said reaction mixture; to effect incorporation in said alkylphenolate of from 2 percent to 6 percent by weight of sulfur; forming a further reaction mixture by introducing into said immediately preceding reaction mixture a further addition of a calcium alkoxyalkoxide of said formula II at a temperature within said first temperature range in a mole ratio of 0.5:1 to 1:1 of said calcium alkoxyalkoxide to initial alkylphenol; and thereafter sequentially hydrolyzing said resulting reaction mixture and contacting the resulting hydrolyzed product with carbon dioxide.

A significantly preferred embodiment of the present invention, involves, more particularly, a sequence of steps the first of which is directed to contacting of the reactants of formulae (I) and (II) hereinabove in a lubricating oil in which they are reacted at a temperature between about 320° F. and 425° F. in a mole ratio of calcium alkoxyalkoxide to alkylphenol of between 0.225:1 and 0.45 to 1. The reaction is conducted until essentially all of the alkoxyalkoxide is reacted; a period, generally of from about 0.5 to about 8 hours, to form the first calcium alkylphenolate reaction product.

As a second stage or step, the resulting first reaction product is contacted, after removal of volatile solvent (where present), with sulfur at a temperature between 440° F. and 460° F., and preferably about 450° F. in the presence of between about 13 and 20 weight percent (wt.%) of a hydrocarbon lubricating oil of an SUS viscosity of between 50° and 2,500° at 100° F. utilizing a mole ratio of sulfur to initial alkylphenol, respectively, of between 0.5 to 1 and 8 to 1; and preferably between about 0.5:1 to 3:1, to form a second reaction mixture. During this addition of sulfur there is passed through this second reaction mixture, sequentially, inert gas, carbon dioxide, and inert gas, the latter preferably nitrogen, until no detectible hydrogen sulfide ($H_2S$) odor is found, which is normally measured at less than 3 parts per million (ppm) $H_2S$, and a copper strip corrosion employing ASTM D-130 of a 2 A maximum (3 hours-212° F.). An inert carbon dioxide gas rate of between about 0.1 to 10 standard cubic feet per hour per gallon (SCFH/gallon) is advantageously employed. The carbon dioxide functions as a deodorizing agent whereas the inert gas functions to facilitate removal of volatile components in the reaction mixture. The reaction time in this second step or stage is generally between 0.5 hours and 10 hours. The resulting second reaction product is a sulfurized calcium alkylphenolate mixture having a sulfur content between 0.1 and 10 weight percent.

The gas blown second reaction product mixture, upon completion of the sulfurization step, is then contacted in a third step with a second quantity of a calcium alkoxyalkoxide of general formula (II) above, at a temperature between about 350° F. and 425° F., and preferably about 370° F., utilizing from 0.15 moles to 0.375 moles, of calcium alkoxyalkoxide per mole of original alkylphenol reactant, the first and second additions of calcium alkoxyalkoxide totalling about 0.6 moles and between 100 percent and 120 percent of stoichiometric. The reaction time of this third stage is generally between about 0.5 and 8 hours. An inert gas flow, preferably of nitrogen, is introduced directly into the reaction mixture in this, as in the other addition stages recited herein (unless otherwise expressly indicated), preferably through the bottom of the reactor from where it is passed through the liquid in upward flow with continuous removal of the gas from the upper region of the reactor system. The nitrogen (or other inert gas) introduced at a rate of from 0.1 to 10 SCFH/gallon exerts a positive pressure in the reactor system of between 1 and 4 p.s.i.g. This method, a standard one, is that employed preferably and normally in the other stages where gas transmission through a reaction mixture is described herein. Further, agitation is employed normally in all stages of the proceudre in order to facilitate ingredient contact.

The third reaction product secured is a crude mixture of the sulfurized normal calcium alkylphenolate, wherein the calcium metal to alkylphenolate ratio is about 1 or slightly in excess thereof (e.g. 10% overbased). This mixture is stripped by continuing the inert gas flow, which is preferably nitrogen, as before, at a rate between about 0.25 and 0.6 SCFH/gallon at a temperature between about 150° C. and 200° C., permitting the low boiling volatile materials to be removed, such as 2-methoxyethanol, the usual solvent employed with the calcium alkoxyalkoxide reactant, and entered into the reaction mixture therewith. Stripping, as described with respect to the various stages of the present process, does not, however, affect removal of the diluent oils introduced in the individual steps of the process.

After stripping of the third reaction product mixture is completed, a fourth step is undertaken in which a fourth reaction mixture is formed incorporating the sulfurized normal calcium alkylphenolate of the third reaction product mixture and a further amount of calcium alkoxyalkoxide in a ratio within the range of 0.5 to 1 mole, and preferably, 1.0 mole, of calcium alkoxyalkoxide per mole of original alkylphenol; that is, from 100 wt.% to 200 wt% of stoichiometric to provide a crude mixture of the desired overbased sulfurized calcium alkylphenolate having a calcium metal value of at least, and preferably 3. In this latter stage, additional hydrocarbon lubricating oil diluent is advantageously added bringing the total hydrocarbon oil diluent content in the third stage to about 40 to 70, preferably about 45 to about 55, and most desirably about 50, weight percent of the fourth stage reaction mixture.

The latter, or fourth reaction or step, is undertaken at 370° C. and under conditions otherwise similar to those utilized in the third and immediately preceding reaction. The fourth reaction product is again stripped by continued nitrogen flow at a gas rate between about 0.25 SCFH/gallon and about 0.6 SCFH/gallon of a temperature between about 302° F. and 392° F. to remove the volatile materials present.

The stripped fourth reaction mixture is then contacted with water in a fifth step or reaction stage for a period of time, e.g., between about 0.1 and 10 hours, and preferably between about 2 and 4 hours, at a temperature between about 50° F. and 482° F., (preferably between 300° F. and 400° F.) utilizing a mole ratio of water to calcium alkoxide reactant of between about 100:1 and 0.2:1 while simultaneously blowing the reaction mixture with nitrogen gas at a rate of between about 0.1 and 0.2 SCFH/gallon, preferably about 0.15 and 0.2 SCFH/gallon. The water in the contacting may be either in its liquid or vapor form or mixtures thereof, and the contacting with water is continued until the overbased sulfurized calcium alkylphenolate is between about 20% and 70% hydrolyzed.

The water of the foregoing hydrolysis step is introduced preferably into the liquid reaction mixture at the bottom of the reactor as steam and passed therethrough. At the completion of the hydrolysis step the residual unreacted water is, desirably, substantially removed from the final reaction mixture, e.g., by stripping with nitrogen gas at a temperature between about 300° F. and 400° F. and at a rate of between about 0.25 and 0.60 SCFH/gallon. The term "substantially removed" is, in relation to the water present, intended to denote removal of water to the extent that less than 1 wt.% thereof by weight of the total fourth reaction product mixture remains.

It is to be noted that the extent of hydrolysis is dependent on time, temperature and reactant ratios, therefore, periodic sampling and analysis is necessary to determine the extent of hydrolysis. As a practical matter, once the amount of hydrolysis is decided upon the particular set of conditions necessary to produce the desired degree of hydrolysis can be determined for a given reactor, obviating the need for periodic sampling.

In the foregoing procedure, it is theorized that the calcium alkoxyalkoxide complexes with, or is dispersed by, the sulfurized normal calcium alkylphenolate and the water hydrolyzes a portion of the complex calcium alkoxyalkoxide moiety with about 50% hydrolysis of said moiety being optimum in respect to stability of the product at high metal ratios.

The hydrolyzed product mixture is treated with carbon dioxide passed through the reaction mixture at a gas rate of 0.1 to 10 SCFH/gallon for a period of about 2 to 4 hours to convert, it is believed, the excess of calcium present as calcium hydroxide to calcium carbonate which is retained in the product mixture and encompassed within the term "overbased" in describing the calcium alkylphenolate product employed in the finished lubricant compositions of the invention. The inert gas normally and preferably employed is nitrogen with a purity of at least 99 wt. %.

The rate of blowing with inert gas during overbasing, stripping of the overbased mixture and hydrolysis is signficant in determining viscosity. Rates employed outside the recited ranges result in a product of substantially increased viscosity. In regard to the unexpected importance of the use of nitrogen and the rate of introduction thereof, it is theorized that the nitrogen gas coupled with its rate of introduction has a direct effect on particle size of the formed hydrolyzed overbased sulfurized calcium alkylphenolate. One explanation is that a rate higher than the maximum produces particles so fine that they are inadequately coated and they agglomerate resulting in a too viscous product of reduced filterability and also a product which has poor solubility even upon filtration and oil dilution. It is further theorized that when the nitrogen gas rate is below the minimum set forth, particles are formed that are so large as to also result in an excessively viscous product and one having poor solubility even upon oil dilution. To summarize, nitrogen gas introduced during overbasing, stripping and hydrolysis affects particle size which in turn affects viscosity, filterability and solubility of the final product. To obtain minimum viscosity and maximum filterability and solubility, a particular set of conditions, ingredients and amounts coupled with a defined rate range of nitrogen gas blowing in the overbasing, stripping and hydrolysis phases is normally used.

The nitrogen gas employed has preferably an impurity content (oxygen and carbon dioxide) of less than about 0.5 wt. percent.

In a less preferred embodiment for formation of sulfurized overbased calcium alkylphenolates such as described herein the initial contact of alkylphenol of formula (I) and calcium alkoxyalkoxide of formula (II) is undertaken at 50° F. to 425° F. and the sulfurization of the second step is thereafter undertaken at a temperature of between 400° F. and 410° F. The neutralization with calcium alkoxyalkoxide is also accomplished in a single step. The calcium alkoxyalkoxide employed is normally half-carbonated, additionally, using $CO_2$ gas. The resulting sulfurized normal calcium alkylphenolate is then overbased by the further sequence that comprises stripping of sulfurized product and completion of the fourth and fifth reaction steps in the same manner, including hydrolysis stripping and filtration, as described hereinabove with respect to the preferred embodiment.

The desired sulfurized overbased calcium alkylphenolate, having a calcium metal to alkylphenolate ratio of 3:2 or within the range of about 2.9:2 and about 3.5:2, realized by the foregoing processes, even when purified in the manner described is, in actuality, a complex mixture of many compounds. One hypothetical formula employed in the art to represent this complex mixture is as follows:

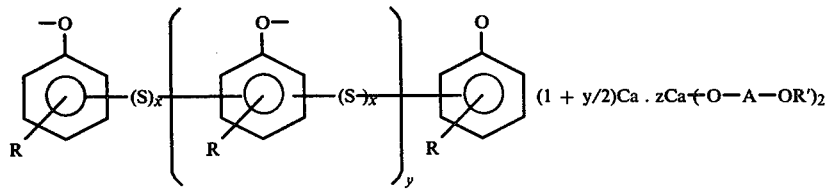

wherein R, R' and A are as heretofore defined, x is an integer from about 1 to 4, y is an average integer of from 0 to 10 and z is an average integer of about 1.9 to about 2.5, and preferably 2.

The foregoing formula is only set forth as a visual presentation since sulfurized calcium alkylphenolate is in essence a complex mixture of many substances including mono- and polysulfides, and therefore, the product can be truly defined only in terms of process. In any case, the R group is believed to be primarily in the para position and the sulfur linked mainly in the ortho position. Further, there is probably also a significant amount of covalent character for the calicum-oxygen bond. It is to be noted that the calcium and sulfur contents of the sulfurized calcium alkylphenolate components are respectively between about 6.0 wt.% and 7.3 wt.% and about 0.5 wt.% and 12 wt.%. While the calcium and sulfur contents of both the preferred and less preferred embodiments of the calcium alkylphenolates for use herein are the same, the preferred embodiment provides a product in combination with the sulfurized naphthenic oil-containing additive of the invention that is significantly superior in securing better diesel engine performance.

Illustrative of the alkylphenol reactants contemplated for use herein are 4-octylphenol, 4-t-octylphenol, 2-decylphenol, 2-dodecylphenol, 4-hexadecylphenol, 3,4-didodecylphenol, 2-nonylphenol, 4-triacontylphenol, 4-eicosylphenol and a mixture of decyl and dodecylphenol ($C_{10}$–$C_{12}$) alkylphenol and a mixture of the 2 and 4 positioned monoalkyl and dialkylphenols. It is to be noted that the alkylphenols employed will normally be p-alkyl-phenols. The 2,4-disubstituted alkylphenols may also be present, but not in excess of 10 wt.% thereof.

Examples of the calicum alkoxyalkoxide reactants contemplated herein are calcium 2-methoxyethoxide, calcium 2-methoxypropoxide, calcium 3-methoxybutoxide, calcium 2-ethoxyethoxide and calcium 4-dodecoxyhexoxide. Their corresponding alkoxyethanol diluents are 2-methoxyethanol, 2-methoxypropanol, 2-methoxybutanol, 2-ethoxyethanol and 4-dodecoxyhexanol.

The final overbased alkylphenolate secured by either the preferred or less preferred embodiment, including hydrolysis and $CO_2$ treatment, where recited, may be further purified by standard means, for example, by distillation of the diluent and by-products, such as the alkoxyalkonal which is not otherwise removed with the excess water. The product mixture is, in any event filtered, if required, by standard means. The preferred filtration is accomplished by adding to the final mixture between about 0.01 wt.% and 1 wt.% of diatomaceous earth and passing the material to be filtered through a press leaf filter precoated with the foregoing filtration medium at a temperature between 200° F. and 300° F. and at a pressure of 5 to 1000 psig.

The diluent oil remaining upon completion of the fourth reaction is made, as indicated hereinabove, to form lubricant concentrates suitable for transport and storage, of from about 45 wt.% to not in excess of 55 wt.%, and preferably 50 wt.%, containing the sulfurized overbased alkylphenolate and sulfurized additive. Suitable diluent or base oils include a variety of hydrocarbon lubricating oils such as naphthenic base, paraffinic base and mixed naphthenic and paraffinic base oils having an SUS viscosity at 100° F. of between about 50 and 250, and preferably between about 90 and 150.

To comply with the critical requirements of the invention, it is necessary that the overbased product of the fifth reaction be blended in the finished lubricant composition with from about 2 wt.% to 6 wt.%, more desirably, 2 wt.% to 3 wt.%, and preferably about 2 wt.% of the second sulfurized additive composition, comprising a sulfurized naphthenic hydrocarbon, and preferably one having an SUS viscosity at 100° F. of 100, and containing, preferably, a sulfurized lard oil formed essentially of triglycerides of $C_{12}$ to $C_{20}$ fatty acids, and particularly and preferably triglycerides of myristic, palmitic and stearic, oleic and linoleic acids, in amounts which, while not narrowly critical, have been found particularly useful in concentrations of 1, 26, 11.5, 58, and 3.5 wt.%, respectively. The foregoing additive may contain inert impurities in amounts of up to 1 wt.% without adverse effect on the additive composition or its usefulness for the purposes of this invention; or may include, most desirably, an anti-wear phosphate additive such as tricresyl phosphate in this concentration. The foregoing second sulfurized additive composition is sulfurized from aobut 1 wt.% to 6 wt.%, more desirably from about 2 wt.% to 5 wt.%, and most desirably to an extent of 2 wt.%; the sulfur being incorporated in combined form. Sulfurization is accomplished by standard means. This sulfurized additive has an SUS viscosity at 100° F. normally within the range of 119 to 255 and preferably about 255, and an API gravity of 19.9.

The formed sulfurized calcium alkylphenolate product contents in lubricating oil compositions contemplated herein range anywhere from 0.1 to 90 wt.%. The higher concentrations, e.g., between about 45 and 55 wt.%, referred to herein as "concentrates" are found normally as, and result directly from, the manufacture of the sulfurized calcium alkylphenolate ingredient. Those concentrates employed for railway diesel engine use are diluted with the lubricant base oil of the finished lubricant oil compositions to a concentration of 0.1 wt.% to 10 wt.%, and more desirably between 0.1 and 7.5 wt.%; with a calcium concentration of between 0.06 and 0.5 wt.% and preferably about 0.1 and 0.4 wt.%. The concentrates are, as thus indicated, principally formed for storage and transport and are subsequently blended to finish oil compositions for engine use. These concentrates have an alkalinity, as manifested by TBN, of 170 to 200.

The concentration employed is sufficient, in any event to effect an alkalinity manifested as a nominal TBN of at least, and more particularly, about 10 to about 20, and for reasons of economy, most desirably, 10, in the finished (dilute) lubricant oils of the invention.

In forming the overbased sulfurized calcium alkylphenolate employed in the foregoing blend of the preferred embodiment of the present invention the calcium alkoxyalkoxide reactant is introduced in the first, third, and fourth reaction mixtures usually as a solution, as indicated hereinabove, to facilitate reaction contact. The solvent medium is usually the corresponding alkoxy-substituted alkanol. In the less preferred embodiment the calcium alkoxyalkoxide addition is effected in the first and third reaction steps using the same solvent media. The preferred alkoxyalkoxide is calcium methoxyethoxide, and consequently the alkanol is normally 2-methoxyethanol. The concentration of the calcium alkoxyalkoxide in the solvent medium is normally between about 20 wt.% and 60 wt.%. The solvent is conveniently and advantageously removed as overhead effluent during the early phases of each step. Preparation of the calcium alkoxyalkoxide reactant is disclosed, by way of illustration, in U.S. Pat. No. 3,706,632.

With respect to the criticalness of the proportions i.e., 13 wt.% to 20 wt.% of hydrocarbon lubricating oil diluent, in the second, or sulfurization, stage, it is believed that where amounts in excess thereof are used, the oil produces too many sites in competition with the calcium alkylphenolate for the suflur, with the result that reduced amounts of sulfur attach to the alkylphenol moieties, thus rendering a product more susceptible to oxidative deterioration. It is also theorized that where less than about 13 wt.% of diluent oil is employed in the sulfurization stage, product results having lower sulfur-alkylphenol bonding, since it appears that the reaction is significantly retarded in this instance.

While it is theorized that the efficacy of the overbased sulfurized calcium alkylphenolate employed herein is explained, in part, by the complex mixture of compounds encompassed therein including monosulfides and relatively unstable polysulfides; and the production predominantly of monosulfides at the reaction temperatures of 440° F. to 460° F. in the preferred embodiment recited herein; unstable cleavage products being produced above this range and the unstable polysulfides resulting in increased amounts below this range, no reasonably conclusive explanation is available to explain why the overbased phenolates described herein, in combination with the second sulfurized additive of the invention, as characterized herein, provide superior silver protective properties.

In the finished lubricating oil compositions, other additives may be included such as supplmentary dispersants, pour depressors, antioxidants, viscosity index improvers, oleogenous agents, antifoamants and mixtures thereof.

Supplemental additives which are desirably included in the lubricant compositions of the invention having particular application to railway diesel engines are ethoxylated inorganic phosphorus acid free, steam hydrolyzed, polybutene-$P_2S_5$ reaction products further described in U.S. Pat. Nos. 3,272,744 and 3,087,956. These supplementary dispersants appear to cooperate with the subject overbased sulfurized calcium alkylphenolate and sulfurized base oil to enhance detergency and thermal stability and resistance to undesired oxidative decomposition. The ethoxylated product is present in the finished compositions of the invention in amounts between 0.3 and 10 wt.% (oil free basis), preferably between about 0.8 and 4 wt.%, and, in any case, in sufficient amount to give a phosphorus content in the finished (dilute) compositions of between about 0.01 and 0.08 wt. %.

The foregoing supplemental ethoxylated phosphorus containing detergent-dispersant is prepared by first reacting a polybutylene of a molecular weight of between about 800 and 2500 wherein the reaction occurs with about 5 to 40 wt. % $P_2S_5$ at an elevated temperature of between about 212° F. and 600° F. in a non-oxidizing atmosphere, e.g. nitrogen, followed by hydrolysis of the resulting product by contact thereof with steam at a temperature between about 212° and 500° F. The steam treatment of the $P_2S_5$-polybutene reaction product results in its hydrolysis to form inorganic phosphorus acids in addition to the hydrolyzed organic product. Hereinbefore and hereinafter the term "polybutene" denotes derivatives of isobutene as well as butene. The inorganic phophorus acids are removed from the hydrolyzed product prior to reaction with alkylene oxide by means of standard procedures such as those disclosed in U.S. Pat. No. 2,987,512 and U.S. Pat. No. 2,951,835 wherein removal is effected by contact with, for example, synthetic hydrous alkaline earth metal silicates. Inorganic phosphorus acids can also be removed by extraction with anhydrous methanol as disclosed in U.S. Pat. No. 3,135,729. The steam hydrolyzed organic phosphorus acid product is then contacted with ethylene oxide at a temperature between about 140° and 300° F. under pressure ranging from 0 to 50 psig utilizing a mole ratio of ethylene oxide to hydrolyzed hydrocarbon-$P_2S_5$ reaction product of between about 1:1 and 4:1; preferably between about 1.1:1 and 1.5:1. Excess ethylene oxide is removed after completion of the reaction by blowing the reaction mixture at an elevated temperature, generally with inert gas such as nitrogen. The foregoing reactions are conducted in the presence of a hydrocarbon lubricating oil of the kind used as a diluent in preparation of the sulfurized overbased calcium alkylphenolate of the invention. The lubricating oil normally constitutes between about 20 and 80 wt.% of the reaction mixture. The introduction of the hydrocarbon lubricating oil normally takes place subsequent to steam hydrolysis. The ethoxylated derivate, on an oil free basis, normally has a sulfur content of between about 2 and 5 wt.% and a phosphorus content of between about 4 and 6 wt.%.

Specific examples of the ethoxylated derivative of the foregoing organic phosphorus, acid, steam hydrolyzed polybutene-$P_2S_5$ reaction products are ethoxylated, steam hydrolyzed, polyisobutene (1100 molecular weight) -$P_2S_5$ reaction product; ethoxylated, steam-hydrolyzed polybutene (1500 m.w.)-$P_2S_5$ reaction product; ethoxylated, steam-hydrolyzed polybutene (800 m.w.)-$P_2S_5$ reaction product, and ethoxylated, steam hydrolyzed, polyisobutene (2000 m.w.)-$P_2S_5$ reaction product. The ethylene oxide component and the reaction product component are present in each of the foregoing compositions in a mole ratio of 1:1.

Other supplementary detergent dispersants, employed as alternatives to the aforedescribed ethoxylated inorganic phosphorus, acid-free, steam hydrolyzed, polybutene $P_2S_5$ reaction products, are the $C_{50}$–$C_{200}$ alkenyl succinimide derivatives of alkylene polyamines of the type described in U.S. Pat. No. 3,172,892 and U.S. Pat. No. 3,210,383. These alternative supplementary succinimide detergents are characterized by the formula:

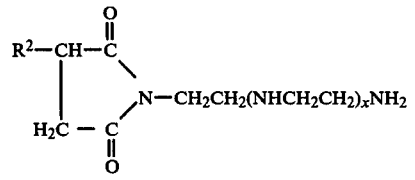

wherein $R^2$ is alkenyl of from 50 to 2000 carbons and x is an integer of from 0 to 10. Particularly suitable examples are where $R^2$ is polyisobutylene of a molecular weight of about 1000 to 1500 and x is 4 or 5 and mixtures thereof.

Like the foregoing polybutene-$P_2S_5$ derivative, this succinimide detergent appears to complement the sulfurized compositions of the invention to enhance their detergency, thermal stability and resistance to undesired oxidation decomposition. The succinic anhydride derivative is present in the finished composition of the invention on a neat basis of between 1.0 and 10 wt.% and in sufficient amount to give a nitrogen content in the finished (dilute) composition of between about 0.01 and 0.12 wt.%, preferably between about 0.015 and 0.3 wt.%.

Still another additive which may be included in the compositions of the invention in addition to the foregoing supplementary detergents are the 2,5-bis-$C_5$—$C_{20}$ alkyldithio thiodiazoles, such as 2,5-bis(octyldithio)-thiadiazole, which function as antioxidants, sulfur scavengers and antiwear agents. The dithiothiadiazoles are advantageously employed in an amount of between 0.01 and 1 wt.%, and preferably between 0.02 and 0.1 wt.% of the finished oil composition.

A still further specific additive which is advantageously included along with the supplementary detergent and antioxidant is a polymeric dimethyl silicone antifoamant. The silicone polymer is desirably employed in amounts of about 100 to 1000 ppm.

The present invention is further illustrated by the following examples, which are not, however, to be construed as limitations thereof. In these examples, as in the remainder of this specification, all references to "parts" or "percentages" are references to parts or percentages by weight unless otherwise expressly indicated.

EXAMPLE I

This example illustrates the preparation of the product of the invention. Throughout the procedure described hereinafter, including each of the steps described, nitrogen blowing of the reaction mixture was conducted at 500 cubic centimeters per minute (cc/min.), unless blowing with $CO_2$ is specified.

Step 1. To a 12 liter flask fitted with a Dean-Stark trap and an inert gas inlet, there was charged 2800 grams of 4-dodecylphenol at ambient temperatures and the product was heated for a period of 2.5 hours at 330° F. There was then charged 1263 grams (2.8 moles calcium) of a 42.3 wt.% Ca solution of calcium 2-methoxyethoxide in 2-methoxyethanol over a period of 1 hour and the methoxyethanol together with other volatile by-product materials, was stripped off for a period of 4.5 hours during which time the temperature was raised from 330° to 410° F.

Step 2: To the calcium alkylphenolate reaction mixture of Step 1, there was charged over an hour period a sulfur slurry (420 grams sulfur+500 grams naphthenic oil of an SUS viscosity off about 110° at 100° F.) while maintaining the temperature at 410° F. Subseuqently, the resultant mixture was heated over an hour period from 410° to 450° F. and maintained at 450° F. for an additional 6 hours, followed by $CO_2$ blowing (500 ccs/minute) for a 1 hour period at 450° F. and then nitrogen blowing was reinstituted for an additional hour at that temperature.

Step 3: The sulfurized reaction mixture of Step 2 was cooled to 350° F. over an hour period and an additional 2630 grams of the aforedescribed naphthenic lube oil was added and the resultant diluted mixture was reheated over a ⅔ hour period from 280° to 330° F. At the end of the reheating period, an additional 1263 grams (2.8 mole) calcium of a 42.3 wt.% solution of calcium 2-methoxyethoxide in methoxyethanol were added over an hour period at 330° F. Subsequently, the resultant reaction mixture is nitrogen stripped to remove methoxyethanol solvent and volatile by-products over a period of four hours while during that period the temperature is raised from 330° F. to 410° F.

Step 4: To the stripped sulfurized normal calcium alkylphenolate product-containing reaction mixture of Step 3 is then added 0.5 mole of calcium 2-methoxyethoxide of a 42.3 wt.% solution of calcium 2-methoxyethoxide in methoxyethanol. The addition is completed over a period of one hour at 330° F. Thereafter, stripping of the reaction mixture with nitrogen is permitted to continue for about 5.5 hours.

Step 5: At the end of this latter period water is introduced into the reaction mixture as steam at a temperature of about 347° F. for a period of 2.2 hours while nitrogen blowing is continued at a decreased rate of 250 SCFH/gallon (with a variation in rate of 0.1 to 0.2 SCFH/gallon) with nitrogen. This hydrolysis step is succeeded by one in which the nitrogen blowing is increased to a rate of 900 SCFH/gallon (with a variation in this rate of 0.25 to 0.6 SCFH/gallon) for a further period of six hours. At the end of this time span, nitrogen blowing is stopped and the raction mixture is blown with carbon dioxide at a rate of 100 SCFH/gallon, for a period of 4 hours while maintaining the temperature at 347° F. At the end of this time, nitrogen blowing is resumed to strip excess $CO_2$ from the reaction mixture. The resulting calcium alkylphenolate, calcium dodecylphenolate, has a calcium metal to alkylphenolate ratio of 3:2 in a concentration of about 50 wt.% in diluent oil. This product is found to have a TBN of between 170 and 180 upon completion of titration with $HClO_4$.

This sulfurized overbased calcium alkylphenolate reaction product is then introduced into a lubricating oil in a concentration of 0.3 wt.% calcium. This dilute product is found, in turn, upon completion of titration with $HClO_4$ to have a TBN of about 10.

To this blend is added 2 wt.% of a second sulfurized additive oil composed of 9 wt.% sulfurized lard oil, 90 wt.% of naphthenic hydrocarbon base oil (including 90 wt.% of pale stock) having an SUS viscosity of 100° F. of 100; and 1 wt.% tricresyl phosphate. This latter or second additive contains 3 wt.% of sulfur. This additive is further characterized by an SUS viscosity at 100° F. of 255 and an API gravity of 19.9. The sulfurized lard oil component contains essentially triglycerides of the following unsaturated fatty acids in the amounts, by weight indicated: myristic acid, 1 percent; palmitic acid, 26 percent; stearic acid, 11.5 percent; oleic acid, 58 percent; and linoleic acid, 3.5 percent. The mineral oil of lubricating viscosity with which the foregoing overbased sulfurized alkylphenolate and sulfurized additive oil are blended to form a finished delicate lubricating oil composition is composed of 2.32 wt.% 300 Pale Oil, 54.24 wt. SN-40 and 43.44 wt.% 75/80 Pale Oil. The lubricant oil is present in an amount by weight of 96.3 percent.

Further additives introduced simultaneously into the foregoing blend are 2.5-bis(octyldithio) thiodiazole in an amount by weight of 0.02 percent and the amine dispersant prepared by reaction of approximately equal mole amounts of tetraethylene pentamine and alkenylsuccinic anhydride in which the alkenyl radical is approximately 1200 molecular weight polybutene; the dispersant content being present in an amount sufficient to provide a nitrogen content by weight of the total composition of 0.02 wt.%. The weight percentage of components recited forming the finished lubricant blend are by weight of the total finished product in each instance. Also included in this blend are 50 parts per million of standard silicone anti-foamant (Dow-Corning "300").

When contrasted with a sulfurized overbased calcium dodecylphenolate prepared as described in Example I hereof from which the sulfurized oil additive, i.e., 3 wt.% sulfurized naphthenic base oil-containing second additive, is omitted, but in which the foregoing nitrogen-containing dispersant thiodiazole and anti-foamant additives are incorporated in like amounts, the sulfurized overbased calcium alkylphenolate-containing lubricating oil shows an unacceptably high viscosity increase (this overbased phenolate is actually about 10 percent overbased, as indicated elsewhere herein); whereas the lubricant oil of the invention incorporating the sulfurized overbased calcium alkylphenolate of this Example I and second sulfurized oil additive manifests excellent results, as evidenced by acceptably low viscosity level, when subjected to the Union Paciffic Oxidation Test (UPOT).

The UPOT consists of heating each of the oils to be tested for 144 hours at 285° F. with oxygen bubbling at 5 liters per hour in the presence of a Cu-Pb steel bearing strip as the catalyst. An acceptable increase in viscosity of a test oil during the test period may not exceed 20 percent.

EXAMPLE II

This example illustrates a further embodiment of the present invention and demonstrates the superiority of the compositions of the invention in protection of silver-plated surfaces.

A sulfurized overbased calcium dodecylphenolate was prepared as described in Example I to provide an overbased sulfurized calcium dodecylphenolate product mixture having a calcium metal to alkylphenolate ratio of 3:2, respectively.

This product is divided into equal portions, one of which is blended with the second sulfurized additive oil of Example I. Both portions are otherwise blended with a mineral oil of lubricating viscosity, and the nitrogen-containing dispersant and thiodizzole additive recited in Example I and in like amounts.

Samples, in like amounts of the foregoing portions of lubricating oil compositions are then tested in what is known to those skilled in the art as the Texaco Modified Silver Disc Friction Test. This procedure is a laboratory test for determining the anti-wear properties of a lubricant. The test machine comprises a system wherein a one-half inch diameter 52100 steel ball is placed in assembly with three one-half inch silver discs of like size and of a quality identical to that employed in the silver pin insert bearings of railway diesel engines manufactured by the Electromotive Division (EMD) of General Motors, Inc. These discs are disposed in contact with one another in one plane in a fixed triangular position in a reservoir containing the oil sample to be tested for its silver anti-wear properties. The steel ball is positioned above and in contact with the three silver discs. In carrying out these tests, the ball is rotated while it is pressed against the three discs at the pressure specified and by means of a suitable weight at the pressure specified and by means of a suitable weight applied to a lever arm. The test results are formulated by reference to the diameters of the scars on the discs, the scar texture, whether scored or smooth, for example, and coloration in a visual rating system using a standard for comparison and a classification of "poor", "fair", "good" and "excellent". The rotation of the steel ball on the silver discs proceeds for a period of 30 minutes at 600 revolutions per minute under a 60 kilogram static load. Each oil is tested at 300° F., 400° F., 450° F., and 500° F.

Under these test conditions, the foregoing lubricant oil containing the second sulfurized oil additive was determined to be "excellent" in providing adequate silver anti-wear properties; whereas the lubricant oil from which the second sulfurized oil additive was absent was to be "poor;" the discs tested with this latter oil being badly scarred.

EXAMPLE III

This example illustrates a further embodiment of the present invention wherein the overbased calcium alkylphenolate component is prepared by an alternative process.

To a 50 gallon reactor fitted with a variable speed stirrer and means for heating, collecting volatile overhead and purging with gases, there was charged 124 lbs. (0.42 mole) of 4-($C_{10}$–$C_{12}$) alkylphenol and 120 lbs. of paraffinic base lubricating oil having an SUS viscosity at 100° F. of about 100. The resultant mixture was heated from ambient to 329° F. over a period of 2 hours while passing nitrogen therethrough at a rate of 0.1 s.c.f.h./lb. mixture. At this point, 106 lbs. (0.21 mole) of a 38 wt. percent calcium 2-methoxyethoxide in methoxyethanol were added and the temperature and nitrogen blowing was continued over a period of an additional 2.5 hours while distilling off methoxyethanol solvent and by-product. At the end of the 2.5 hour period there was charged to the residue 16.8 lbs (0.525 mole) of a 46 wt. percent sulfur in a lubricating oil slurry, said lubricating oil having a viscosity of about 100 SUS at 100° F., and the temperature was raised to and maintained at 356° F. for a period of 4 hours with $N_2$ continuing at a rate of 0.1 s.c.f.h./lb. Then for deodorization 6 lbs. of $CO_2$ were blown in over 4 hour period, followed by $N_2$ at 0.4 s.c.f.h./lb. for 1 hour. The stripped mixture was filtered through a pressure filter at 284° F. under 10 p.s.i. utilizing 2.8 lbs. diatomaceous filter aid. The recovered filtrate (280 lbs.) gave the following analysis

TABLE I

| Test: | Result |
|---|---|
| Calcium, wt. percent | 2.95 |
| Sulfur, wt. percent | 2.7 |
| TBN[1] ($HClO_4$ *titration*) | 81.4 |
| Specific gravity 60/60 | 0.9715 |
| Viscosity, SUS 210° F. | 127 |
| Flashpoint, °F. | 360 |
| Sulfated ash, wt. percent | 9.7 |

[1]Total base number.

The filtrate was determined to be a lubricating oil solution containing 50 wt. percent sulfurized normal calcium 4-$C_{10}$–$C_{12}$ alkylphenolate having a calcium metal ratio of 1.

To 4500 grams (3.32 moles) of sulfurized normal calcium 4-($C_{10}$ $C_{12}$)alkylphenolate lube oil solution filtrate produced by the process of Example I and of diluent oil (100 SUS at 100° F.) there was charged 3776 grams (6.98) moles) of calcium 2-methoxyethoxide solution (that has been previously subjected to blowing with $CO_2$ gas at a rate of 500 cc per minute for a period sufficient to render the reagent half-carbonated) and the resultant mixture was nitrogen blown at a rate of 100 ml./min. while heating to 194° F. Then 478 mls. (26.5 moles) of water in 500 mls. of 2-methoxyethanol were continuously introduced into the reaction mixture at 194° F. over a period of ½ hour. The reaction mixture was then nitrogen blown (100 ml./min.) for a period of 2 hours at 194° F., then stripped of excess water and solvent at 356° F. utilizing 500 $N_2$ ml./min. At the end of 3½ hour period at 356° F. the mixture was filtered through a heated funnel under mild vacuum (18 mm. Hg) utilizing 50 g. diatomaceous earth filter aid.

The filtrate was identified as a lubricating oil solution containing 45 wt. percent overbased sulfurized calcium 4-$C_{10}$-$C_{12}$ alkylphenolate which is about 50% hydrolyzed having a calcium metal ratio of 2. Further analysis found the following.

TABLE II

| Test: | Result |
|---|---|
| Viscosity, cs. at 210° F. | 57.4 |
| Flashpoint, °F. | 375 |
| Calcium, wt. percent | 4.4 |
| Sulfur, wt. percent | 2.4 |
| TBN ($HClO_4$ titration) | 120 |
| $H_2O$, wt. percent | <1 |

The foregoing filtrate, when introduced into a lubricating oil in a concentration of 0.3 wt.% together with 2 wt.% of the second sulfurized additive oil and the other additives in like amounts recited in Example I, that is 2,5-bis-(octyldithio) thiodiazole, alkenylsuccinic anhydride, and silicone anti-foamant demonstrated an "excellent" result when evaluated by the Texaco Modified Silver Disc Friction Test described in Example II hereof, whereas an identical formulation, but for the absence of the sulfurized naphthenic oil-containing additive, gave a "poor" result.

It will be evident that the terms and expressions exmployed herein are used as terms of description and not of limitation. There is no intention, in the use of these descriptive terms and expressions, of excluding equivalents of the features shown and described, or portions thereof, and it is recognized that various modifications are possible within the scope of the invention claimed.

What is claimed is:

1. A lubricating oil composition comprising:

a hydrocarbon base oil of lubricating viscosity having an SUS viscosity at 100° F. of between about 50 and 250;

a sulfurized overbased calcium alkylphenolate having a calcium metal to alkylphenol ratio of at least 2.9:2, a calcium content by weight of the total composition of between 6 and 7.4 percent, and a sulfur content of between 0.5 percent and 12 percent of the total composition;

wherein said sulfurized overbased calcium alkylphenolate is produced by the step-wise process that comprises:

(1) introducing into contact with an alkylphenol of the formula:

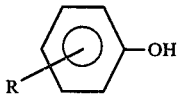

(I)

wherein R is from 1 to 2 monovalent alkyl radicals, each containing from 4 to 50 carbons, a calcium alkoxyalkoxide of the formula:

$$Ca—(-O\text{-}A\text{-}OR')_2 \quad (II)$$

wherein A is an alkanediyl radical of from 1 to 6 carbon atoms, and R' is an alkyl radical of from 1 to 25 carbon atoms, at a temperature between 200° F. and 425° F., utilizing a mole ratio of calcium alkoxyalkoxide to said alkylphenol of from 0.5:1 to 0.6:1;

(2) introducing into contact with the resulting reaction mixture, sulfur in the presence of carbon dioxide at a temperature of from 410° F. to 450° F., utilizing a mole ratio of sulfur to initial alkylphenol of between 0.5:1 and 8:1, and a hydrocarbon lubricating oil, said hydrocarbon oil constituting between about 13 percent and 20 percent by weight of said reaction mixture; to effect incorporation in said alkylphenolate of from 2 percent to 6 percent by weight of sulfur to form sulfurized alkylphenolate, (3) forming a third reaction mixture by further introducing into said sulfurized alkylphenolate a further addition of a calcium alkoxyalkoxide of said formula II in the presence of carbon dioxide at a temperature within said first temperature range in a mole ratio of 0.5:1 to 1:1 of said calcium alkoxyalkoxide to initial alkylphenol; and (4) thereafter hydrolyzing said third reaction mixture; said sulfurized overbased alkylphenolate being employed at a concentration in said lubricating oil composition to give said lubricating oil composition an alkalinity expressed as total base number of at least 10; and an effective silver anti-wear amount of a second sulfurized additive composition comprising a sulfurized naphthenic hydrocarbon lubricating oil wherein combined sulfur is present within a range of about 1 percent to about 6 percent by weight.

2. A lubricating oil composition as claimed in claim 1 wherein said alkylphenol is dodecylphenol.

3. A lubricating oil composition as claimed in claim 1 wherein said calcium alkoxyalkoxide is calcium 2-methoxyethoxide.

4. A lubricating oil composition as claimed in claim 3 wherein said calcium 2-methoxyethoxide is dissolved in methoxyethanol.

5. A lubricating oil as claimed in claim 1 comprising a concentrate wherein said sulfurized overbased calcium alkylphenol is present in a concentration of about 45 percent to about 55 percent weight of said concentrate and said second sulfurized additive composition is present within a range of about 2 percent to about 6 percent of said concentrate.

6. A lubricating oil as claimed in claim 1 wherein said second sulfurized additive contains from 2 percent to 3 percent of sulfur by weight of said total second additive composition.

7. A lubricating oil composition as claimed in claim 1 wherein said sulfurized overbased calcium alkylphenolate has a calcium metal to alkylphenolate ratio of from 2.9:2 to 3.5:2.

8. A lubricating oil composition as claimed in claim 1 wherein said sulfurized overbased calcium alkylphenolate has a calcium metal to alkylphenolate ratio of about 3:2.

9. A lubricating oil composition as claimed in claim 1 and including additionally between about 1 percent and 10 percent by weight of a supplementary dispersant consisting of an alkenyl succinic anhydride derivative of an alkylene polyamine characterized by the formula:

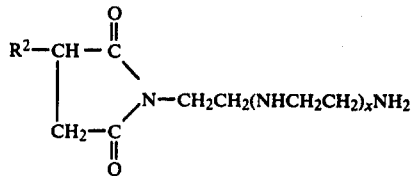

wherein $R^2$ is an alkenyl radical of from 50 to 200 carbon atoms, and x is an integer of from 0 to 10, inclusive.

10. A lubricating oil composition as claimed in claim 1 containing an effective amount of 2,5-bis (octyl dithiothiadiazole).

11. A lubricating oil as claimed in claim 1 having a TBN of from about 10 to about 20.

12. A lubricating oil as claimed in claim 1 wherein said overbased sulfurized calcium alkylphenolate of the third reaction product mixture is hydrolyzed to between 20 percent to 70 percent.

13. A lubricating oil as claimed in claim 12 wherein said overbased sulfurized calcium alkylphenolate of the third reaction product mixture is hydrolyzed to about 50 percent.

14. A lubricating oil composition according to claim 9 containing a minor amount of a sulfurized lard oil.

15. A lubricating oil composition according to claim 14 containing an effective anti-wear amount of tricresyl phosphate.

* * * * *